United States Patent [19]

Palmieri

[11] 4,315,794

[45] Feb. 16, 1982

[54] DEVICE FOR THE QUICK SPLICING OF PAPER WEBS

[75] Inventor: Angelo Palmieri, Zola Predosa, Italy

[73] Assignee: Carle & Montanari S.p.A, Bologna, Italy

[21] Appl. No.: 136,751

[22] Filed: Apr. 3, 1980

[30] Foreign Application Priority Data

Apr. 3, 1979 [IT] Italy ..... 12536 A/79

[51] Int. Cl.[3] ..... B31F 5/06

[52] U.S. Cl. ..... 156/504; 156/505; 83/100; 242/58.1

[58] Field of Search ..... 156/157, 159, 502, 504, 156/505, 506; 242/58.1, 58.4, 58.5; 83/100, 508.1, 667, 673

[56] References Cited

U.S. PATENT DOCUMENTS

| | | | |
|---|---|---|---|
| 1,985,755 | 12/1934 | Wood | 83/667 |
| 3,925,131 | 12/1975 | Krause | 156/159 |
| 3,939,031 | 2/1976 | Takimoto | 156/505 |
| 4,067,760 | 1/1978 | Nelson | 156/157 |
| 4,097,323 | 6/1978 | De Roeck et al. | 156/159 |

FOREIGN PATENT DOCUMENTS 1580727 12/1980 United Kingdom .

*Primary Examiner*—John E. Kittle

*Attorney, Agent, or Firm*—Lowe, King, Price & Becker

[57] ABSTRACT

The device for the quick splicing of two paper webs comprises a pair of conveying roller for feeding both webs in overlapping relationship at the same speed, a rotary blade, arranged downstream of the conveying rollers, for cutting simultaneously both overlapping and running webs, two discarding spools, arranged one on each side of the path of the running webs, for removing a severed portion of one of the webs, a splicing roller, positioned on the same side of the rotary blade, with respect to the path of the running webs, and finally a pair of drawing rollers, for drawing the web which has been spliced at the same speed as the conveying rollers. The rotary blade is mounted on a roller-like supporting element, and on this supporting element there is provided, immediately after the blade in the direction of rotation of same, a trough-shaped longitudinal suction groove, which has the purpose of removing the cut leading end of a web from the path of the running webs, during an operational phase of the splicing device. The suction groove is selectively connected to a suction source.

6 Claims, 10 Drawing Figures

DEVICE FOR THE QUICK SPLICING OF PAPER WEBS

SUMMARY OF THE INVENTION

The present invention relates to a device for the quick splicing of two running webs, and more particularly to a device for the joining of paper webs in continuous feed systems, such as automatic wrapping machines.

According to the present invention, there is provided a splicing device suitable for joining two webs, which webs are wound on bobbins and are suitable for use in a packaging machine, without stopping a packaging machine in cooperation with which the apparatus may be used, which device comprises means for causing a length of a first web, which first web is to be unwound from a new bobbin, to pass in a parallel and substantially superposed relation over a corresponding length of a second web, which second web is being unwound from a bobbin which is shortly to be depleted, conveying means for acting, under control and in timed relation, on the superposed lengths of web, which conveying means are suitable for causing the webs to be moved towards a packaging machine, in cooperation with which the device may be used, at a suitable synchronous speed and also with the required tension, means for cross cutting in timed relation the two superposed lengths of webs when they are being conveyed by the conveying means, for collecting and removing the short portion of the first web originating from the cross cut, and further comprises splicing means for applying, in the correct time relationship and so as to bridge the cut of the expiring web and the new web a splicing adhesive tape.

According to a first aspect of the invention, the cutting or severing means consist of a rotary blade which is mounted on a roller-type supporting element, and on the said supporting element there is provided, immediately after the blade in the direction of rotation of same, a suction groove which is trough-shaped and is sufficiently deep to attract at its interior in a substantial manner the leading end of the tail portion of the expiring web, in the course of one splicing operation, which tail portion must be moved away from the path of the running webs, in order to permit, for the mentioned particular splicing operation, a correct splicing of the new web to the expiring web. The particular shape of the trough-like suction groove ensures the perfect detachment of the web to be removed from the underlying web.

According to a second aspect of the invention, the splicing means for applying the adhesive tape consist of one roller arranged at one side of the path of the running webs, and precisely at the same side of the rotary blade, which roller presents at least one suction bore for the positioning of the adhesive tape. The provision of the splicing means on only one side of the path of the running webs, greatly simplifies the intervention of the operator which controls the device, and avoids errors in the positioning of the splicing adhesive tape, which errors frequently occurred in machines presenting two separate splicing rollers, one on each side of the path of the running webs.

According to a third aspect of the invention, suitable registering means are provided for bringing a detectable mark provided on the new web, into register with a fixed reference mark on the stationary support of the device, which fixed reference mark can be adjusted depending on the thickness of the web being employed, so that the splicing of webs containing inscriptions or designs can be effected in a very precise manner, with the minimum waste material.

The above and other features of the invention, and the advantages deriving therefrom, will appear evident from the following detailed description of a preferred embodiment.

DESCRIPTION OF THE PREFERRED EMBODIMENT

Figure 1:
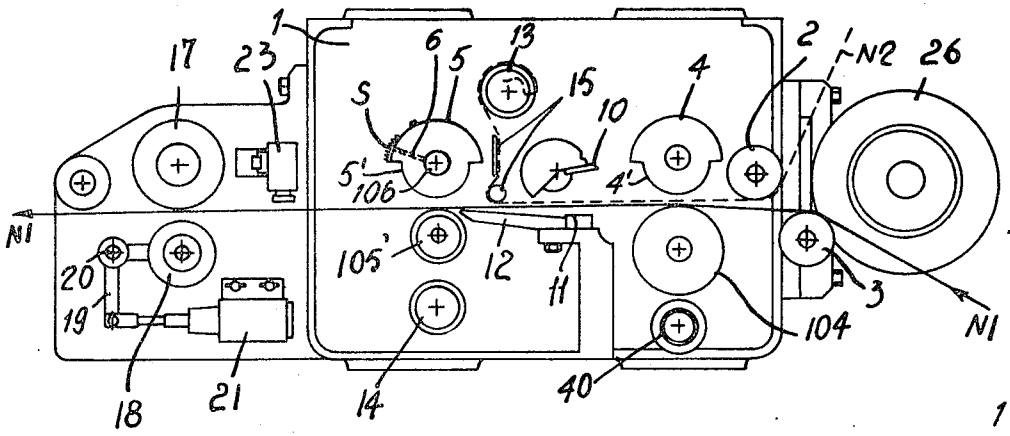
FIGS. 1 and 2 are views in side elevation of the splicing device according to the invention, in two different operational positions.
Figure 2:
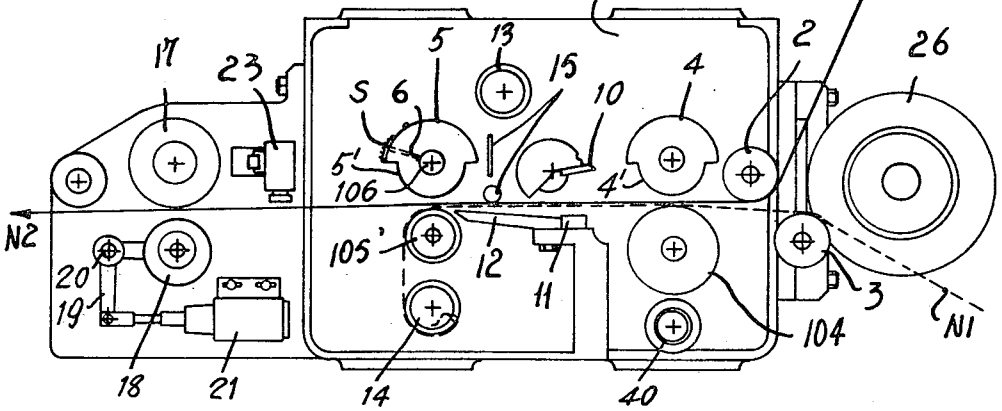
Figure 3:
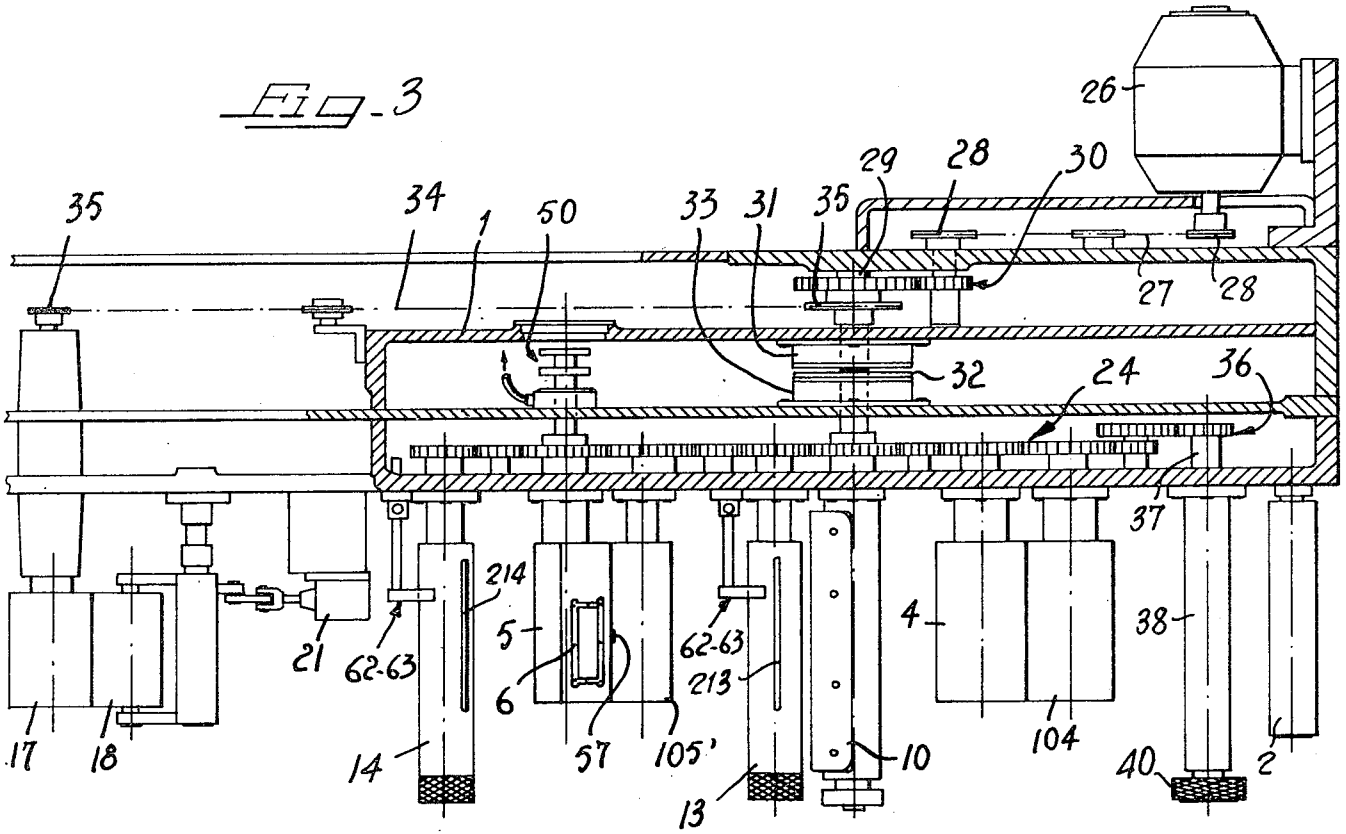
FIG. 3 shows a top part-sectional view of the device with different gears and components thereof aligned on the same plane, for a better understanding of its operation.
Figure 4:
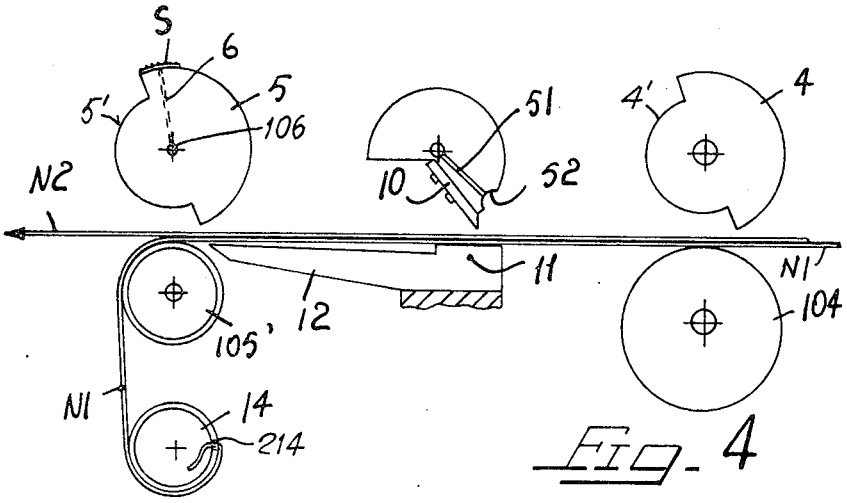
FIGS. 4, 5, 6 and 7 show diagrammatically as many operational phases of the device according to the invention.
Figure 5:
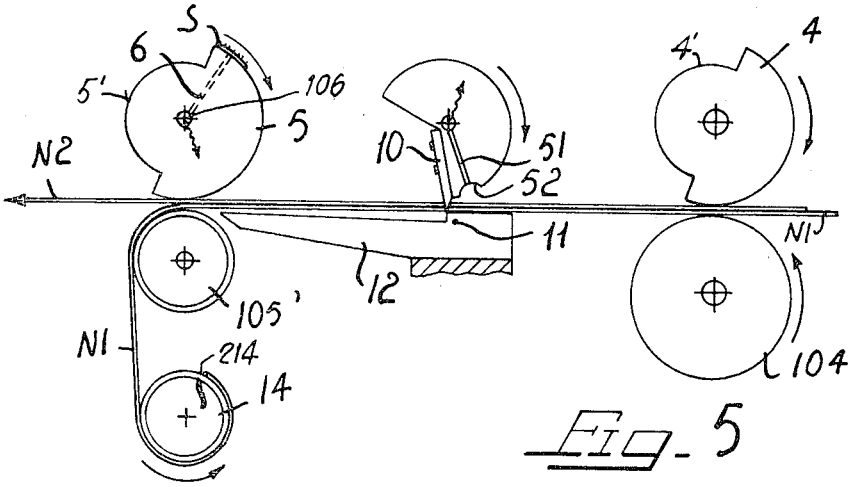
Figure 6:
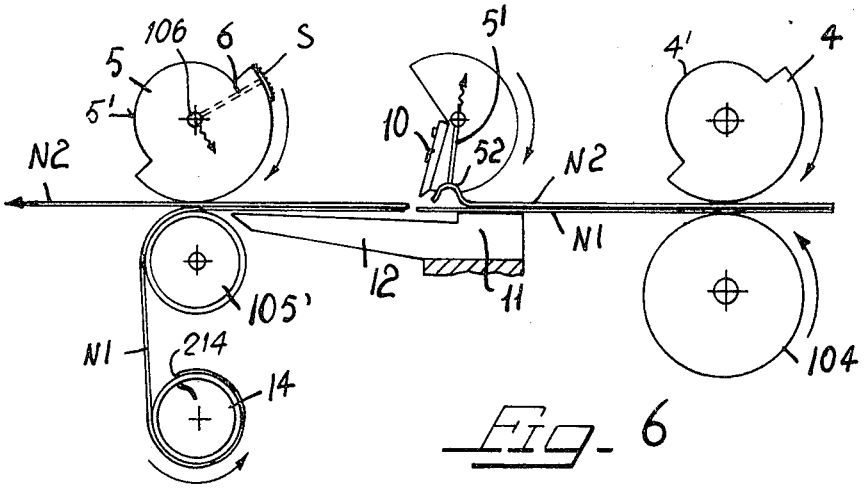
Figure 7:
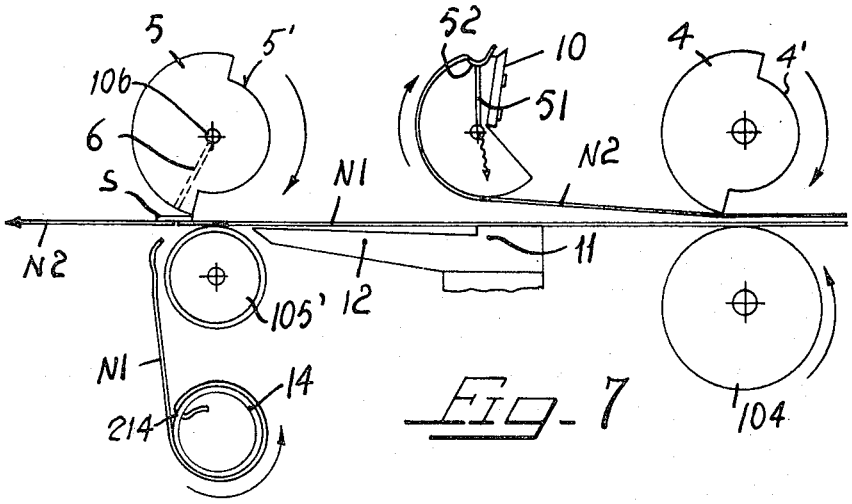

Referring to the drawings, the device in accordance with the present invention is preferably installed between the reels or bobbins, and the compensating means which ensure the feeding of the wrapping web to the packaging machine under controlled tensioning independently of the inertia of the reel which is inserted in the packaging cycle. As shown in FIGS. 1 to 3, the device comprises a composite base structure 1, inside which are arranged gears and drives for driving a set of roller type conveyor means, horizontally and parallelly arranged projecting from one side of the structure 1.

A first pair of idle rollers 2 and 3 guarantees the feeding, in correct position, of webs N2 and N1 from the reels. Two pairs of rollers 4, 104 and 5, 105' are provided, in spaced apart and aligned relationship, downstream of the idle rollers 2 and 3. The rollers 4, 104 and 5, are kinematically interconnected in such a manner that the upper rollers 4 and 5 rotate in clockwise direction and the lower roller 104 rotates in anticlockwise direction, at a speed which is equal to that of the upper rollers. The lower roller 105' is mounted freely rotatable. At least one of the rollers of each of the two pairs 4, 104 and 5, 105' is lined with a yieldable elastic material (in the present case the lower rollers 104 and 105'), while the other rollers are of metal and present a circumferential recess extending 180° 4' and 5'. As a result, when the roller pairs are in their inoperative or rest position (as shown in FIGS. 1 and 2), the wrapping web running from a reel to the packaging machine can pass freely through the recesses 4' and 5'.

Web-cutting means are provided between the two roller pairs 4, 104 and 5, 105' and comprises a rotary blade 10 mounted on a roller-type supporting block which upon control is rotated in a clockwise direction at a peripheral speed equal to the speed of the rollers, and a counterblade 11 secured to the structure 1.

A guide member 12 secured to the structure 1 supporting the counterblade 11 is provided immediately downstream of the counterblade and extends substantially up to or towards the contact area between the rollers 5 and 105. Spools 13 and 14 are provided downstream of the cutting means, above and below the same. The spools 13 and 14 are kinematically connected to the rollers and can be rotated upon control, in a clockwise and in anticlockwise direction, respectively, at a peripheral speed equal to the speed of the said rollers. The spools 13 and 14 (which act as a discarding device) are mounted onto their respective shafts with the interposition of friction means, and are provided with longitudinal slots 213, 214, respectively, for the anchoring of the leading end of the wrapping web which is to be connected to the web which is about to be exhausted, the said web being correctly positioned by passing at one side (lower) over the idle roller 105' and at the other (upper) over the guide members 15.

The device is completed by a pair of drawing rollers 17, 18 located downstream of, and in aligned relationship with respect to rollers 5 and 105'. The upper roller 17 is kinematically connected to the roller 5 so as to rotate in a clockwise direction and at the same peripheral speed, while the lower roller 18 is idly supported by a fork 19 fulcrumed at 20 and operatively connected to a double-acting cylinder and piston unit 21, so that the roller 18 may be moved into contact with or away from the upper roller 17. At least one sensor 23, for example a photoelectric cell sensor, is situated upstream of the rollers 17 and 18 and is connected to a logic circuit for the purposes which will become apparent hereinafter. As shown in FIG. 3, the previously described rollers (with the exception of roller 105') and the rotary blade 10 are connected, between them, in cascade by means of a gear trein 24. The said rollers are driven in rotation at a peripheral speed which is substantially equal to, or is suitably greater than, the maximum speed at which the wrapping web is requested from the packaging machine, by a motor 26 secured to the structure 1. Through a chain 27 and pinion 28, the shaft of the motor 26 is connected to a speed down gear 30 on which there is keyed an electromagnetic clutch 31, which, whenever energised, attracts a disc 32, in turn keyed onto the shaft of the rotary blade 10. When the device is in the rest position the disc 32 is normally attracted by an electromagnetic unit 33 secured to the structure 1 and acting as braking element. Starting from the gear 30, there is also provided a positive transmission consisting of, for example, a chain 34 and pinions 35 for actuating the drawing roller 17. The gear train 24 is connected to a gear wheel 36 which is in turn keyed onto a shaft 37 arranged for rotation at the interior of a tubular support 38 secured to the structure 1. At the interior of the support there is also rotatably mounted an inner shaft which can be rotated by means of the external knob 40, and is normally disconnected from shaft 37 by elastic means. By pushing the knob 40 towards the support 38, it is possible to couple the knob 40 and shaft 37 through frontal coupling of any known type.

With particular reference to FIGS. 4 to 7, it is noted that the roller-like element which carries the rotary blade 10 is provided, immediately after the said blade (considering the clockwise direction of rotation) with a longitudinal groove 52 arranged aligned on one generatrix of the roller-like element, and presenting a set of bores opening into said groove 52, which bores can selectively communicate, through ducts 51, with a suitable suction source (not shown). The longitudinal suction groove 52 presents a semicircular section or in any case a rounded trough-shaped section and it presents also a suitable depth, so as to be able to attract substantially at it interior, due to the suction exerted through the ducts 51, the leading end of wrapping web N2, which has been cut by the rotary blade 10 and which has to be discarded, as it will be more particularly described hereafter.

Figure 8:
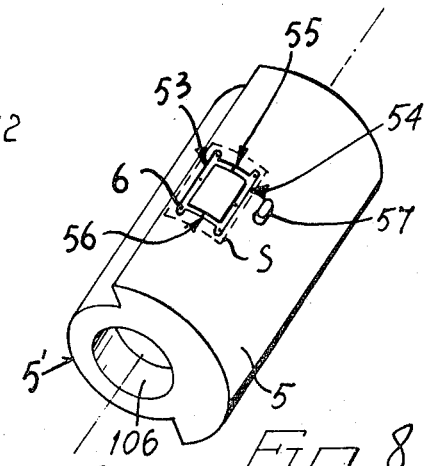
FIG. 8 is a perspective view of the splicing roller for applying the adhesive tape.

Referring now to FIGS. 3 and 8, it is noted that the roller 5, which serves for applying the splicing adhesive tape S, presents at least two sets of suction bores 6 which are aligned along two generatrices of the roller, at the interior of suitable grooves 53, 54, and preferably it presents also other two sets of transversely aligned bores at the interior of grooves 55, 56. The suction bores 6 are connected, in any know manner, to a suitable suction source (not shown) through axial duct 106. In this manner, there is obtained a sufficiently wide rectangularly defined suction area which serves for a better positioning of the splicing adhesive tape S.

Still with reference to FIG. 8, roller 5 presents also a marking punch 57 which in cooperation with roller 105' acting as counter-punch, cuts a bore in the web in proximity of the spliced ends, for the purposes which will be explained after.

Figure 9:
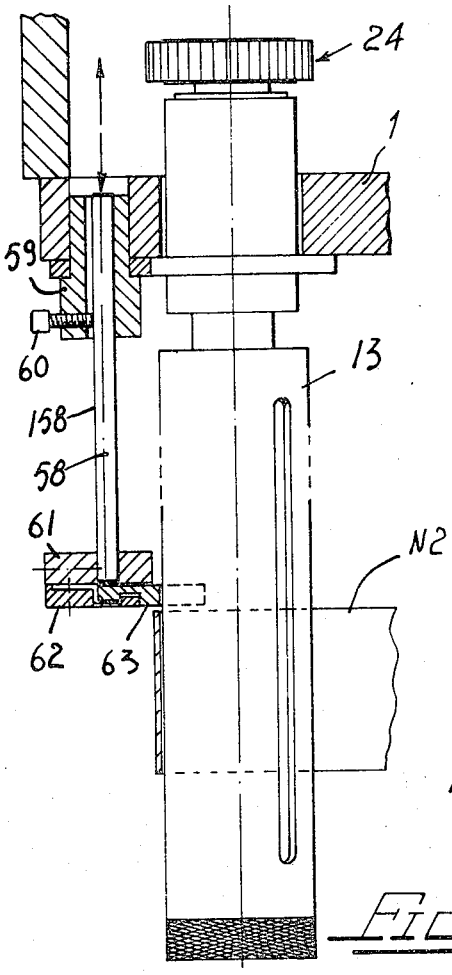
FIG. 9 is a top view, with parts in sections, of the index plate registering means for the correct positioning of the new web to be spliced to the exhausting web.
Figure 10:
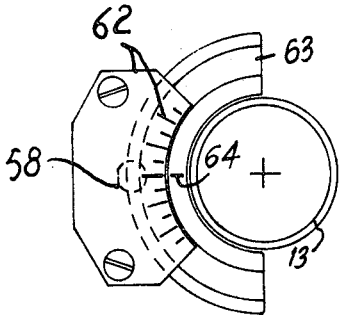
FIG. 10 is a front view of the index plate registering means of FIG. 9.

In FIGS. 3, 9 and 10 there is illustrated an index plate device, which serves for the precision adjustment of the starting position of the web to be spliced, as it will be explained after. The index plate adjusting device is provided in connection with the spools 13 and 14 (which act as discarding device) and it comprises a rod 58 parallel to spool 13 (the arrangement for spool 14 being identical) and which can be axially shifted (but not rotated) along seat 59, provided in the structure 1, with the possibility of being blocked in a determined longitudinal position by means of the locking screw 60, acting on a longitudinal flattened portion 158 of rod 58. The rod 58 carries at its free end a support head 61 presenting an index plate 62 which is arcuate and concentric to the spool 13 and which carries markings corresponding to different thicknesses of the wrapping web being used. On index plate 62 there is slidably mounted, for movement along a circumferential path, a slide 63 which carries a reference marking 64.

The operation of the just described splicing device will be now explained, by considering the two possible modes of operation, which differ substantially the one from the other, and depend from the relative position of the two webs which have to be spliced together, and more precisely:

(a) The "reserve" web (N2) unwound from the "reserve" or "standby" reel, and which must be spliced to the "exhausting" web (N1) unwound from the "exhausting" or "depleted" reel, is located on the same side (regarding the running web) of the rotary blade 10. This relative position of the two webs is illustrated in FIG. 1.

(b) Relative position of the two webs illustrated in FIG. 2: the "exhausting" web (N2) is located on the same side of the rotary blade 10.

(a) Reserve Web on the Side of the Rotary Blade

Referring to FIG. 1, the web N1 (lower web in the Figure) is allowed to pass freely through the device in its rest position. The said web N1 is unwound from an exhausting reel (not shown) and is fed to a wrapping machine (not shown).

The web N2 (upper web) is unwound from a reserve reel (not shown), passed over roller 2 and through the device, between rollers 4 and 104, the rotary blade and the counterblade 11, and then deflected upwardly over guide means 15 and anchored to the slot 213 of the spool 13. The spool 13 is then manually turned, to guarantee a sure anchoring of the web N2, and also to cause a selected mark (inscription or drawing) on the web N2 to coincide with the reference marking 64 of the index plate device 62–63 (FIGS. 9 and 10).

A portion of adhesive tape S is positioned on the suction bores 6 of the roller 5 with its adhesive surface turned, that is facing, outwardly. When the exhausting reel is about to be completely exhausted, a control is operated to actuate the motor 26, the sensor 23 and the logic circuit which is connected thereto, while the device remains stationary, owing to the de-energisation of the electromagnetic clutch 31. When the sensor 23 senses the presence of the predetermined reference mark on the web N1, a control is issued to cause actuation of the cylinder 21 to lift the roller 18 against the roller 17 and to cause energisation of the electromagnetic clutch 31. The web N1 is thus unwound from its exhausting reel under the draft of the rollers 17 and 18 and also due to the action of the rollers 4, 104 and 5, 105', which also engage the web N2 by unwinding it from its respective reserve reel at the same speed as that of web N1. During this step, the spool 13 takes up the web N2 from the guide members 15 and thus maintains the web N2 in the required conditions of tensioning and overlapping with respect to the web length N1, between the roller pairs 4, 104 and 5, 105'. At a certain moment, the rotary blade 10 moves the co-operate with the fixed counterblade 11 and effects cutting of the superposed webs N1, N2. The two webs are cut exactly at the same point of the inscriptions or drawings existing on the same, thanks to the previously effected setting up operation.

The cutting separates the web portion of web N1 connected to the packaging machine from the remaining web portion coming from the exhausted reel, while the section of web N2 which is anchored to the spool 13 is separated from the thus formed novel leading end of the web N2 unwound from the reserve reel. The cut ends of the two superposed webs N1, N2 are moved forward in mating end-to-end relationship because of the synchronous conveyance effected by the roller pairs 4, 104 and 5, 105'. In correspondence of the guide members 15 the section of the web N2 anchored to the spool 13 is deflected from the web N1 passing to the packaging machine, so that the web N1 advances towards the contact area between the rollers 5, 105' while being in mating end-to-end relationship, with its trailing end, both with the end of the remaining portion of web N1 still coming from the exhausted reel and with the new leading end of the web N2. When passing through the rollers 5, 105', the trailing end of the web N1 is spliced to the leading end of the web N2, by positioning the adhesive tape S in a bridge-like manner on the web ends.

At this stage, suitable sensors co-operating for instance with cams 50 on the shaft of roller 5 (FIG. 3) control the de-energisation of the electromagnetic clutch 31 and the energisation of the electromagnetic brake 33, which locks the several rollers in the angular position shown in FIG. 1, so that the web N2 drawn from the reserve reel can freely pass through the roller pairs 4, 104 and 5, 105'. In correct time relationship, the rollers 18 and 17 are moved apart and the motor 26 is stopped. Thus the device reaches it rest condition.

At this point, the operator removes the discarded portion of web N2 from spool 13, and also takes away the remaining portion or "tail" of web N1 (from the exhausted reel).

By acting on knob 40 and consequently rotating the shaft 37 (FIG. 3) the operator can rotate the cylinders 4, 104, 5 and the rotary blade 10, so as to bring them precisely again in the starting position of the device. When the said rotary blade 10 and the mentioned rollers have reached their correct starting position, a suitable sensor device, actuated for example by a cam 50 keyed on the shaft of roller 5, automatically controls the electro-magnetic brake 33 which locks the device in the said starting position.

It is to be noted that during the above described splicing operation, with the reserve web on the same side of the rotary blade, no suction is applied through the suction ducts 51 of the suction groove 52 of the rotary blade 10.

(b) Exhausting Web on the Side of the Rotary Blade

Referring to FIG. 2, the web N2 (upper web in the Figure) is allowed to pass freely through the device in its rest position. The said web N2 is unwound from an expiring reel (not shown).

The web N1 (lower web) is unwound from a reserve reel, passed over roller 3 and through the device, between rollers 4 and 104, the rotary blade 10 and the counterblade 11, over guide member 12, over roller 105', and anchored to the slot 214 of the spool 14. The spool 14 is then manually turned, to guarantee a sure anchoring of the web N1, and to cause a selected mark on the said web N1 to coincide with the reference marking 64 of the index plate device associated to said spool 14, in an analogous manner to what described with reference to spool 13.

A portion of adhesive tape S is positioned on the suction bores 6 of the roller 5. When the reel of web N2 is about to be completely exhausted, a control is operated to actuate motor 26, the sensor 23 and the logic circuit connected thereto, while the device remains stationary, owing to the de-energisation of the electromagnetic clutch 31. When the sensor 23 senses the presence of the predetermined reference mark on the web N1, a control is issued to cause actuation of the roller 18 against the roller 17 and to cause the energisation of the electromagnetic clutch 31.

The web N2 is thus unwound from its reel under the draft of the rollers 17 and 18 and also due to the action of the rollers 4, 104 and 5, 105', which also engage the web N1 by unwinding it from its respective reel at the same speed as that of web N2. During this step, the spool 14 takes up the web N1 from the guide 12 and roller 105' and thus maintains the web N1 in the required conditions of tensioning and overlapping with respect to the web length N2, between the roller pairs 4, 104 and 5, 105'. At a certain moment (FIG. 5) the rotary blade 10 moves to co-operate with the fixed counterblade 11 and effects cutting of the superposed webs N1, N2. The two webs are cut exactly at the same point of the inscriptions or drawings existing on same, thanks to the previously effected setting up operation.

It is to be noted that, during this splicing operation, suction is applied through the ducts 51 of the roller of the rotary blade 10, and therefore the groove 52 is under suction. As clearly shown in FIG. 6, while the driving rollers 4, 104 and 5, 105' prosecute their feeding action of the superposed webs, the suction groove 52 takes up the leading end of the "tail portion" of the upper web N2 unwound from the exhausting reel and positively moves it apart from the leading end of the reserve web N1 which prosecutes its movement towards the pair of rollers 5, 105'.

Thanks to the semicircular, concave section of the trough-shaped suction groove 52, the detachment of upper web N2 from the underlying web N1 takes place in a safe manner, without the possibility that the two superposed webs remain attached together, due to the natural tendency to this kind of adhesion which occurs between superposed sheets, and also due to presence of particular coating layers of any type on one or both faces of the webs, which might render them sticky to a certain extent. In fact, as it is apparent from FIG. 6, the leading end of the web N2 which has been just cut by the rotary blade 10, is actually pushed downwardly due to the sucking of the immediately consecutive portion of the said web, thus cooperating for a positive detaching action, as it can be clearly appreciated from the said FIG. 6.

The leading end of the reserve web N1 prosecutes alone its forward movement in the direction of rollers 5, 105, in mating end-to-end relationship with the cut trailing end of the exhausted upper web N2 and the cut trailing end of the initial portion of web N1 which is being wound on the discarding spool 14. When passing through the rollers 5, 105' the trailing end of web N2 is spliced to the leading end of web N1 (FIG. 7) by positioning the adhesive tape S in a bridge-like manner on the web ends. The initial portion of the reserve web N1 is definitely discarded by being wound on spool 14.

At this moment, the device is stopped under the action of the electromagnetic brake 33. The operator removes the discarded portion of web N1 from spool 14, and can remove the tail of the exhausted web N1, since the control means have also disconnected the suction source from the suction groove 52 of the rotary blade 10. The device can be set again for a new splicing operation which evidently will be indentical to the operation previously described.

With particular reference, again, to FIGS. 9 and 10, it is to be noted that the manual adjustment by acting on spools 13 and 14 must be effected in order to compensate the variations in the speed of the running webs which are due to the thickness of the webs themselves. In fact, a greater or lesser thickness of the webs employed results into a greater or lesser speed of the webs taken up by the spools 13 and 14, due to the overall increase of diameter of the spools with the web wound thereon. Each marking 62 on the index plate 61 corresponds, as above mentioned, to a different thickness of the webs.

In addition, always with reference to FIG. 9, it is noted that the semicircular slide 63 serves also as alignment member for the web to be spliced. In fact, thanks to the rod 58 and to the locking screw 60, the semicircular slide can be longitudinally shifted according to the width of the web being employed. As it can be appreciated by FIG. 10, the semicircular slide 63 encircles the cylindrical surface of the spool of a substantial arc, which in the case shown is of 180°. The gap between the said slide 63 and the surface of the spool is minimum.

In the foregoing description, there have been omitted some details relating to the construction and/or operation of some parts, since they either well known or easily conceivable by a person skilled in the art. The above details may relate, for instance, to the means for selectively controlling the suction to the groove 52 of the rotary blade 10 in the different operational situations, and the logic circuit connected to sensor 23.

It is believed that the invention will have been clearly understood from the foregoing detailed description of the preferred embodiment. Changes in the details of construction may be resorted to without departing from the spirit of the invention, and it is accordingly intended that no limitation be implied and that the hereto annexed claims be given the broadest interpretation to which the employed language fairly admits.

I claim:

1. A device for the quick splicing of two webs, for use with a wrapping machine, comprising conveying means including a pair of rollers (4, 104) both driven at the same peripheral speed for feeding both webs in overlapping relationship at the same speed, with the webs being pressed between said rollers; severing means for simultaneously severing both overlapping and running webs, said severing means comprising a blade (10) carried on rotary supporting means and a counterblade (11); discarding means (13,14) arranged downstream of the said severing means, for removing a severed portion of one of the webs; splicing means (5) for applying adhesive tape onto the cut trailing end of one web and the cut leading end of the other web; drawing means (17, 18) comprising a pair of cooperating rollers at least one of which is a driving roller, for drawing the web being spliced at substantially the same speed as the conveying means, with the web being pressed between said rollers, a substantially trough shaped suction groove positioned on the rotary supporting means adjacent to and after the blade (10) in the direction of rotation, said suction groove (52) extending longitudinally along substantially the whole width of the blade and having a depth capable of curling the cut leading end of one web for positive detaching action of the overlapping webs; and means for selectively connecting said suction groove (52) with a source of suction to effect web detaching action.

2. A splicing device according to claim 1, in which the trough-shaped suction groove has a section according to an arc of a circle, and presents a plurality of suction bores arranged at the bottom of said groove.

3. A splicing device according to claim 1, in which the splicing means (5) for applying adhesive tape on the cut trailing end of one web and on the cut leading end of the other web, consist of a splicing roller, arranged downstream and on the same side of the rotary blade with respect to the path of the running webs, said splicing roller presenting on its cylindrical surface at least one suction bore for the positioning of the adhesive tape thereon, and cooperating with a counter roller, mounted on the other side of the path of the running webs.

4. A splicing device according to claim 1, wherein said splicing means (5) includes a splicing roller arranged downstream and on the same side of the blade with respect to the path of the running webs, said splicing roller having a cylindrical surface including a pair of suction grooves arranged along generatrices of the cylindrical surface, said suction grooves interconnected to a second pair of suction grooves arranged transversely thereto defining a substantially rectangular shape, said splicing means including a piece of adhesive tape positioned on the suction grooves, said splicing roller cooperating with a counter roller mounted on the opposite side of the path of the running webs.

5. A splicing device according to claim 3, in which the splicing roller further presents, on its cylindrical surface, a marking punch (57) for the marking of the spliced web in correspondence of the splicing zone.

6. A splicing device according to claim 1, in which the discarding means for removing a severed portion of one of the webs comprise, on each side of the path of the running webs, a reel (13, 14) provided with a slot suitable for anchoring an initial portion of the web, the periphery of each reel being rotatable by friction means at the same speed as the peripheries of the conveying rollers, each reel being manually rotatable to bring a mark on the web into register with a mark on the stationary support of the reel, said mark on the stationary support being provided on a circular slide encircling at least partially the cylindrical surface of the reel, said slide being movable along an index plate presenting different markings for different thicknesses of the webs employed.

* * * * *